US006353952B1

(12) United States Patent
Wells

(10) Patent No.: US 6,353,952 B1
(45) Date of Patent: Mar. 12, 2002

(54) POSTURIZED BEDDING OR SEATING PRODUCT WITH SPRINGS OF DIFFERING HEIGHTS

(75) Inventor: Thomas J. Wells, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/583,804

(22) Filed: May 31, 2000

(51) Int. Cl.[7] ..... A47C 27/05
(52) U.S. Cl. ..... 5/716; 5/717; 5/727; 5/740
(58) Field of Search ..... 5/716, 717, 718, 5/719, 721, 727, 730, 739, 740

(56) References Cited

U.S. PATENT DOCUMENTS 1,682,394 A * 8/1928 Meutsch ..... 5/717
2,480,158 A 8/1949 Owen
2,742,957 A 4/1956 Young
3,166,768 A * 1/1965 Cunningham ..... 5/727
3,769,643 A * 11/1973 Adler ..... 5/727
5,222,264 A 6/1993 Morry
5,713,088 A 2/1998 Wagner et al.
5,724,686 A 3/1998 Neal
6,122,787 A * 9/2000 Kao ..... 5/727
6,158,071 A * 12/2000 Wells ..... 5/717

FOREIGN PATENT DOCUMENTS

GB 380582 9/1932

* cited by examiner

*Primary Examiner*—Michael F. Trettel
(74) *Attorney, Agent, or Firm*—Wood, Herron & Evans, LLP

(57) ABSTRACT

A bedding or seating product having a spring core made up of a plurality of coil springs arranged in rows and columns. The spring core is divided into sections, each section having springs of an identical height. The springs of one section are taller than the springs of another section. Filler is placed above the shorter springs in select sections. The taller springs are of a greater firmness than the filler material, thus creating a posturized effect.

19 Claims, 8 Drawing Sheets

POSTURIZED BEDDING OR SEATING PRODUCT WITH SPRINGS OF DIFFERING HEIGHTS

FIELD OF THE INVENTION

This invention relates to a posturized bedding or seating product in which certain sections are firmer than other sections of the product.

BACKGROUND OF THE INVENTION

Conventional bedding or seating products have a spring core made of a plurality of coil springs arranged into a matrix of rows and columns of coil springs. Each of the coil springs has an upper end turn and a lower end turn, with a plurality of central convolutions therebetween. The diameter of the end turns may be identical to the diameter of the central convolutions of the spring. Alternatively, the end turns of the coil springs may be of a larger or smaller diameter than the central convolutions of the springs. Typically, the coil springs are of the same height for ease of assembly. The coil springs are connected by securing the end turns of adjacent springs to each other.

The end turns of adjacent coil springs are most commonly clipped together or secured together with helical lacing wires. Such helical lacing wires encircle the end turns of adjacent coil springs, thus securing the end turns together and hence preventing the coil springs from separating from one another. Encircling the upper and lower end turns of all of the coil springs with such helical lacing wires creates a unitary spring core which is covered with padding and wrapped in an upholstered material. Such spring cores have a uniform relatively firm feel across the entire upper surface of the product due to the end turns of the coil springs being secured to each other.

In order to impart a softer, more resilient feel to the bedding or seating product, the spring cores of such products have been modified to change the location of the helical lacing wires connecting the coil springs of the spring core. U.S. Pat. Nos. 2,480,158 and 5,713,088 disclose spring cores comprising a plurality of aligned coil springs joined together with helical lacing wires, the helical lacing wires being spaced below the upper end turns of the coil springs. As a result, the sections of the coil springs located above the helical lacing wires provide an increased flexibility at the upper ends of the coil springs, thus imparting a softer feel to the upper surface of the bedding or seating product.

U.S. Pat. No. 5,713,088 discloses a spring core in which helical lacing wires are spaced below the upper end turns of the coil springs and above the lower end turns of the coil springs so as to create a two-sided mattress with a "soft" feel on both surfaces of the mattress. Such a mattress is considered a "two-sided" mattress because it has an identical feel on both sides.

Although each of these patents discloses a spring core in which the helical lacing wires or connectors are inwardly spaced from the terminal end convolutions of the coil springs to impart a softer feel to at least one surface of the bedding or seating product in which the spring core is used, these products are not posturized, i.e., they have a uniform feel across the entire upper surface thereof.

Consequently, it has been one objective of the present invention to provide a posturized bedding or seating product utilizing springs of differing heights so as to impart differing degrees of firmness to different sections of the product.

It has been a further objective of the present invention to provide a bedding or seating product having a spring core of rows and columns of coil springs connected by helical lacing wires spaced below the upper end turns of select coil springs.

It has been a further objective of the present invention to provide a posturized bedding or seating product in which filler material is placed between groups of springs, the filler material resting upon the upper end turns of other groups of springs.

SUMMARY OF THE INVENTION

The invention of this application which accomplishes these objectives comprises a bedding or seating product which is posturized so as to impart different degrees of firmness to different sections of the product.

The bedding or seating product comprises a spring core, filler located above at least one section of the spring core, and an upholstered covering surrounding the filler and the spring core.

The spring core comprises a plurality of coil springs arranged in transversely extending rows and longitudinally extending columns. Each of the coil springs has an upper end turn, a lower end turn and a plurality of central convolutions between the end turns. The spring core is divided into sections, each of the sections comprising a plurality of coil springs of an identical height. The coil springs of at least one of the sections are of a first height which, for purposes of this application will be considered short coil springs. The coil springs of at least one of the sections comprises coil springs of a second height greater than the first height, which, for the purposes of this application will be considered tall coil springs.

In one preferred embodiment of the present invention, the spring core is divided into multiple sections, each section having several transversely extending rows of identical coil springs of the same height. At least one of these sections comprises coil springs of a first height and at least one other section comprises coil springs of a second height greater than the first height. Filler is located above the sections of coil springs of a first height. The filler imparts a softer feel to the user than does the end turns of the coil springs of a second height. Consequently the sections comprising rows of short coil springs (those of a first height) and filler above such springs are of a lesser firmness than the firmness of the other sections comprising rows of tall coil springs (those of a second height).

In several preferred embodiments of the present invention, the filler is of a third height so that when placed upon the springs of a first height, the sum of the first and third heights is approximately equal to the height of the tall springs, i.e., the second height. In such a manner, the bedding or seating product has a uniform upper surface comprising the upper end turns of the tall coil springs and the upper surface of the filler.

The filler may be numerous structures and/or materials, including but not limited to pieces of urethane foam, various fibrous materials, air bladders or water bladders or even matrixes of short springs contained in cloth fiber pockets.

In another preferred embodiment of the present invention, the sections may extend from head to foot rather than from side to side. In this preferred embodiment, each section comprises a plurality of longitudinally extending columns of coil springs of an identical height.

In one preferred embodiment of the present invention, the coil springs are joined together with helical lacing wires. Upper helical lacing wires encircle the upper end turns of the short coil springs and intermediate convolutions of the tall coil springs. In this preferred embodiment, lower helical lacing wires encircle the lower end turns of all of the coil springs. The lower end turns of all of the coil springs are in a generally horizontal plane and define the bottom surface of the bedding or seating product.

In another preferred embodiment the tall coil springs of a second height extend above and below the end turns of the short springs of the spring core. In this embodiment upper and lower helical lacing wires encircle the upper and lower end turns of the short coil springs, respectively and intermediate convolutions of the tall coil springs. In this embodiment, filler is located both above and below the short coil springs. The upper and lower surfaces of the filler are generally coplanar with upper and lower end turns of the tall coil springs, respectively.

In another preferred embodiment of the present invention, tall coil springs are arranged in a generally rectangular pattern in the middle of the bedding or seating product, and short coil springs (springs of a lesser height than the springs in the middle of the product) are arranged around the perimeter of the generally rectangular section of tall coil springs. Filler is placed above the short coil springs around the perimeter of the bedding or seating product in order to provide a softer feel to the user around the perimeter than in center of this embodiment of product.

In another preferred embodiment of the present invention, a section of short coil springs are arranged in a generally rectangular pattern in the middle of the bedding or seating product. Tall coil springs (springs of a greater height than the springs in the middle section of the product) are arranged around the perimeter of the generally rectangular section of short coil springs. Filler is placed above the short coil springs in the middle of the bedding or seating product. The tall springs provide an edge support around the perimeter of the product which is of a greater firmness than the central section or core of the product.

DETAILED DESCRIPTION OF THE DRAWINGS

Figure 1:
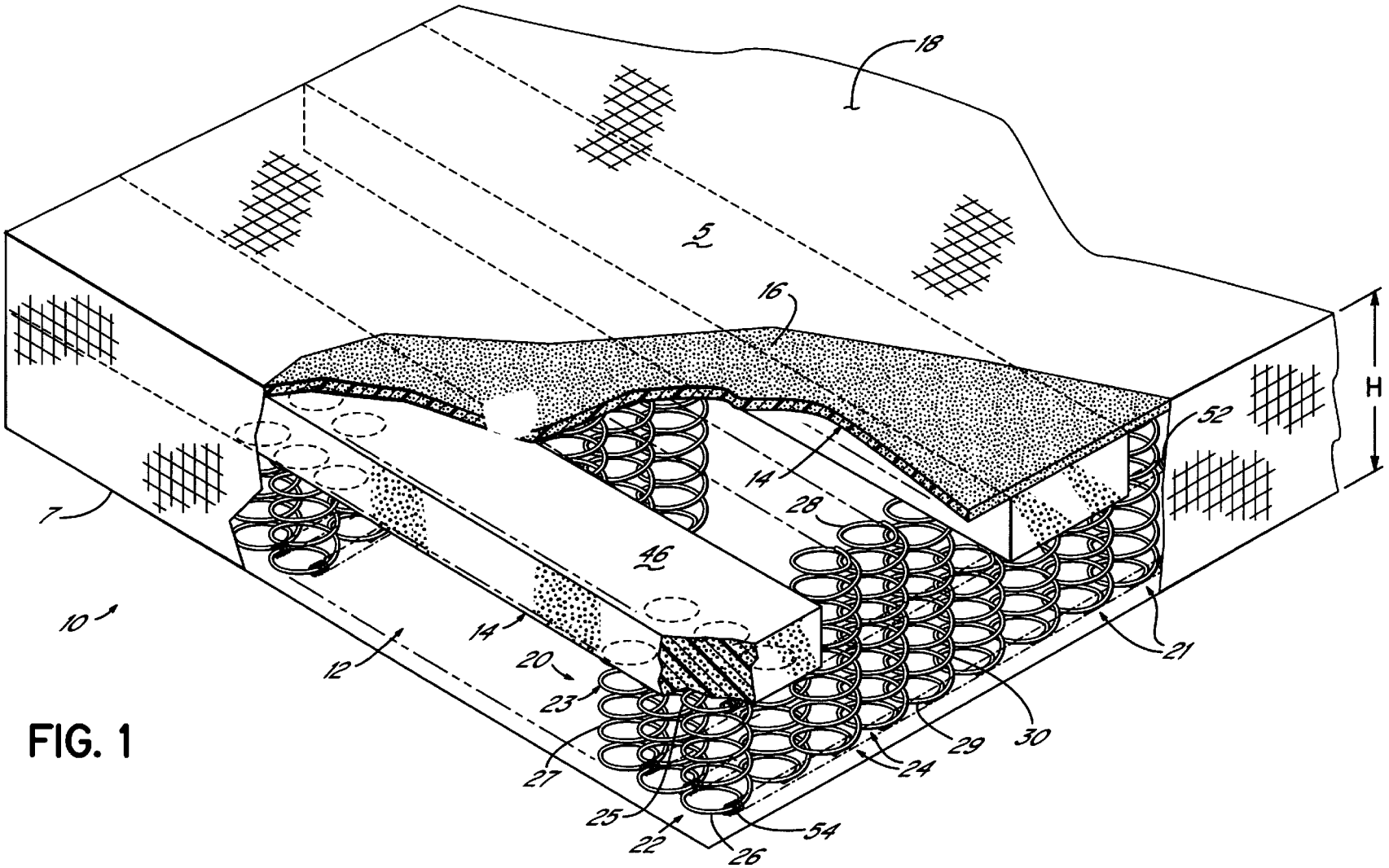
FIG. 1 is a perspective view partially broken away, of a bedding or seating product made in accordance with the present invention.

Referring to the drawings and particularly to FIG. 1 there is illustrated a bedding or seating product 10. The bedding or seating product 10 comprises a spring core 12, filler 14, a layer of padding 16 and an upholstered covering 18. Select pieces of filler 14 rest on top of the spring core 12, the padding 16 overlays the filler 14 and spring core 12, and the upholstered covering 18 surrounds the spring core 12, filler 14 and padding 16. The product 10 has an upper surface 5 and a lower surface 7, the distance between the upper and lower surfaces 5,7 defining a height H of the product 10.

Figure 1A:
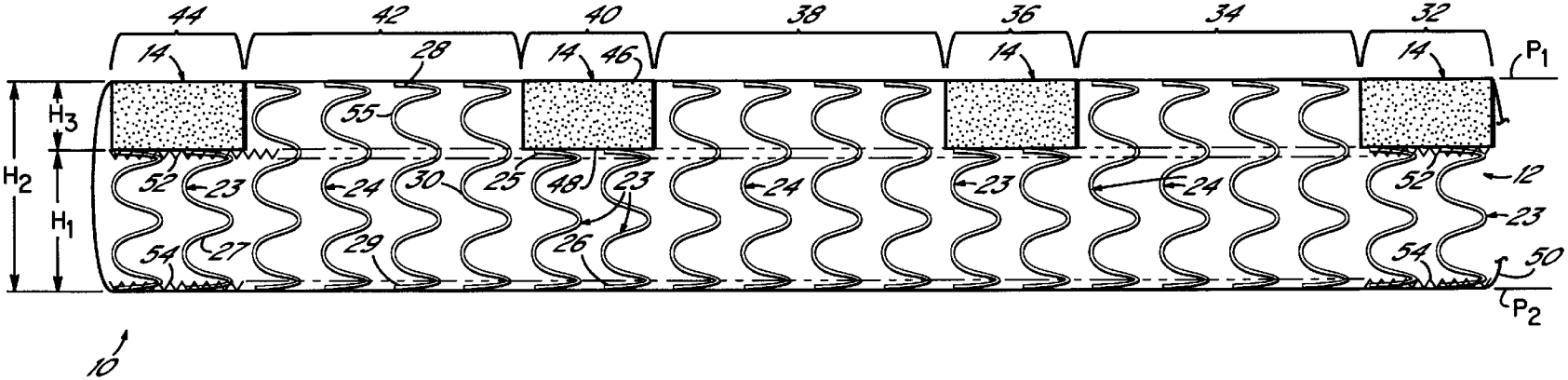
FIG. 1A is a schematic side elevational view of the bedding or seating product illustrated in FIG. 1.

The spring core 12 comprises a plurality of individual coil springs 20 arranged in transversely extending rows 21 and longitudinally extending columns 22. As illustrated in FIG. 1A, two different configurations of coil springs are incorporated into the spring core 12: short coil springs 23 of a first height $H_1$ and tall coil springs 24 of a second height $H_2$. Each of the short coil springs 23 has an upper end turn 25, a lower end turn 26 and a plurality of central convolutions 27 between the end turns 25,26.

Similarly, each of the tall coil springs 24 has an upper end turn 28, a lower end turn 29, and a plurality of central convolutions 30 between the end turns 28 and 29. Although one configuration of short coil spring and one configuration of tall coil spring are illustrated and described, the present invention may be utilized in accordance with many other different configurations of springs, including, but not limited to the following: springs with offsets therein to aid in joining together multiple springs, Bonnel type springs having knotted end turns, and modular springs.

Referring to FIG. 1A, along the longitudinal dimension of the bedding or seating product, the product is divided into a plurality of sections of differing firmness so as to posturize the product. Moving from right to left in FIG. 1A, the product is divided into a head section 32, a shoulder section 34, an upper back section 36, a middle back section 38, a lower back section 40, a thigh section 42, and a foot section 44. The head, upper back, lower back and foot sections 32,36,40,44 are of a lesser firmness than the firmness of the shoulder, middle back and thigh sections 34,38,42, respectively. For purposes of this application, the shoulder, middle back and thigh sections, 34,38, and 42, each comprising rows of tall springs 24, will be considered "firm" sections and the head, upper back, lower back and foot sections 32,36,40, and 44, each comprising rows of short coil springs 23 and filler 14, will be considered "soft" sections. Although FIGS. 1 and 1A illustrate four soft sections and three firm sections, any number of firm sections of any size and any number of soft sections of any size may be incorporated into the product of the present invention, depending upon the desired application. Similarly, the location of the different sections may be varied depending upon the firmness effect desired.

Each of the coil springs 20 within a particular section is identical and of the same height. As illustrated in FIGS. 1 and 1A, the short coil springs 23 of the head, upper back, lower back and foot sections 32,36,40 and 44 are of a first height $H_1$. The tall coil springs 24 of the shoulder, middle back and thigh sections 34,38,42 are of a second height $H_2$, greater than the first height $H_1$ and approximately equal to the height of the product H. As best seen in FIG. 1A, the tall coil springs 24 extend above the upper end turns 25 of the short coil springs 23 within the spring core 12.

As best illustrated in FIGS. 1 and 1A, pieces of filler 14 are located in the head, upper back, lower back and foot sections 32,36,40 and 44, respectively above the short coil springs 23. The filler 14 rests on top of the upper end turns 25 of the short coil springs 23. Each of the pieces of filler 14 has an upper surface 46 and a lower surface 48. The distance between the upper and lower surfaces 46,48 defines a third height $H_3$ such that the sum of the first height $H_1$ (the height of the short coil springs) and the third height $H_3$ (the height of the pieces of filler 14) equals the second height $H_2$ (the height of the tall coil springs). As best illustrated in FIG. 1A, the upper end turns 28 of the tall coil springs 24 are generally coplanar in a horizontal plane $P_1$ with the upper surfaces 46 of the pieces of filler 14, thus creating a relatively uniform upper surface 5 of the product. As is conventional, an upholstered covering 50 surrounds the insulator pad 16, the pieces of filler 14 and the spring core 12.

The short coil springs 23 and the tall coil springs 24 are joined together with upper helical facing wires 52 and lower helical lacing wires 54. As best illustrated in FIG. 1, in this preferred embodiment the upper and lower helical lacing wires 52,54 encircle the end turns of adjacent columns of coil springs and extend longitudinally. However, such helical lacing wires may extend transversely in a direction parallel the rows 21 of the spring core as well. The upper helical lacing wires 52 encircle the upper end turns 25 of the short coil springs 23 and one of the intermediate convolutions 30 of the tall coil springs 24. Thus, an upper portion 55 of each tall coil spring 24 extends above the upper helical lacing wires 52.

In the preferred embodiment illustrated in FIGS. 1 and 1A, the lower helical lacing wires 54 encircle the lower end turns 26,29 of both the short and tall coil springs 23,24, respectively. The lower end turns 26,29 of the short and tall coil springs 23,24 are generally coplanar in a horizontal bottom plane $P_2$.

Although helical lacing wires are illustrated and described as being used to join the coil springs of the spring core together, in any of the embodiments of the present invention, adjacent coil springs may be clipped together, hog-ringed together or connected with other types of fasteners.

Figure 2A:
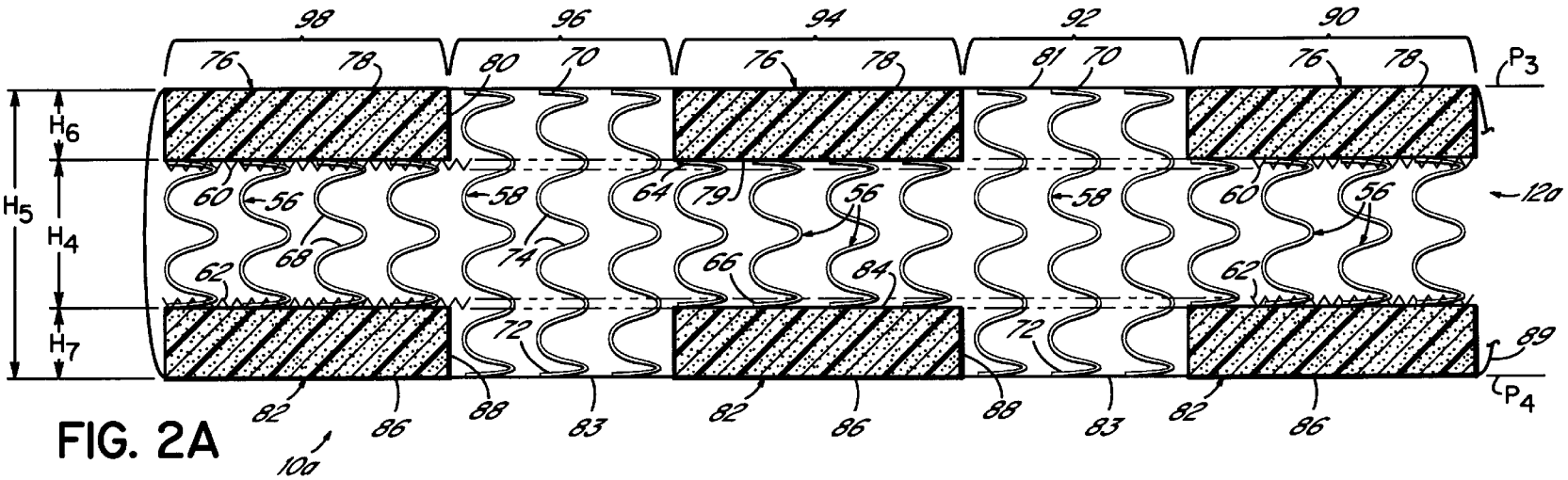
FIG. 2A is a cross-sectional view taken along the line 2A—2A of FIG. 2.
Figure 2:
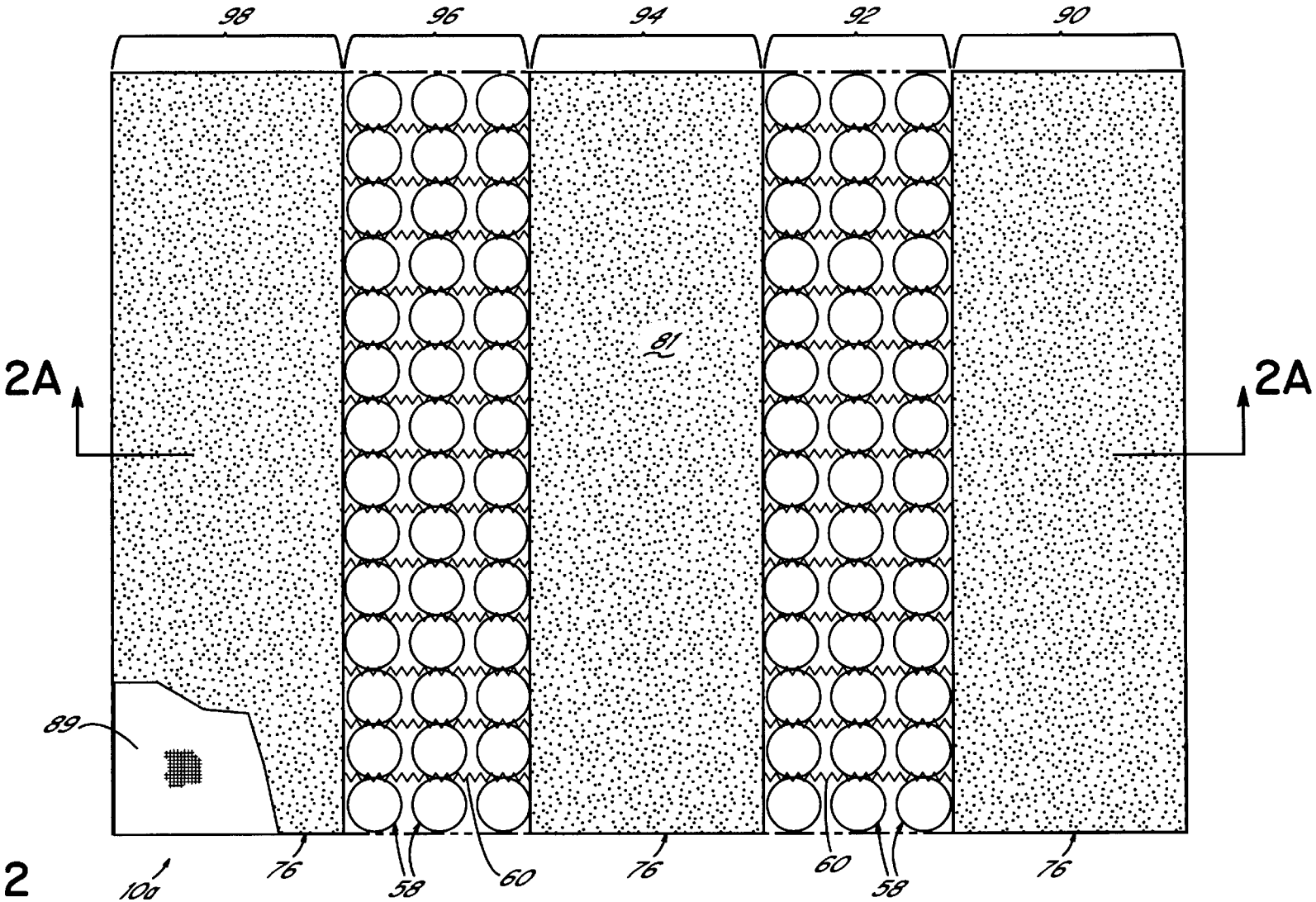
FIG. 2 is a top view of an alternative preferred embodiment of the present invention.

FIGS. 2 and 2A illustrate an alternative embodiment of bedding or seating product 10*a*. This embodiment of product 10*a* has a spring core 12*a* made up of short coil springs 56 and tall coil springs 58 joined together with upper helical lacing wires 60 and lower helical lacing wires 62. Each of the short coil springs 56 is of a fixed height $H_4$ defined between an upper end turn 64 and a lower end turn 66. A plurality of central convolutions 68 are between the end turns 64,66. Similarly, each of the tall coil springs 58 has an upper end turn 70, a lower end turn 72 and central convolutions 74 between the end turns 70,72. Each of the tall coil springs 58 is of a fixed height $H_5$ greater than the height $H_4$ of the short coil springs 56.

The upper helical lacing wires 60 encircle the upper end turns 64 of the short coil springs 56 and intermediate convolutions 74 of the tall coil springs 58. Similarly, the lower helical lacing wires 62 encircle the lower end turns 66 of the short coil springs 56 and intermediate convolutions 74 of the tall coil springs 58. The tall coil springs 58 extend both above the upper end turns 64 of the short coil springs 56, a distance $H_6$ and below the lower end turns 66 of the short coil springs 56, a distance $H_7$. Although distances $H_6$ and $H_7$ are illustrated as being approximately equal, they may differ.

Pieces of filler 76 are located both above the upper end turns 64 of the short coil springs 56. Each of the pieces of filler 76 has an upper surface 78, a lower surface 79 and side surfaces 80. The distance between the upper and lower surfaces 78,79 defines a height $H_6$ so that when resting on the upper end turns 64 of the short coil springs 56, the upper surfaces 78 of the pieces of filler 76 are generally coplanar with the upper end turns 70 of the tall coil springs 58. The upper surfaces 78 of the pieces of filler 76 and the upper end turns 70 of the tall coil springs 58 create a generally uniform upper surface 81 located in a top plane $P_3$ (see FIG. 2A).

Similarly, below each of the short coil springs 56 is a piece of filler 82 having an upper surface 84, a lower surface 86 and side surfaces 88. The vertical distance between the upper and lower surfaces 84,86 defines the thickness or height $H_7$ of each piece of filler 82. As best illustrated in FIG. 2A, the lower end turns 66 of the short coil springs rest upon the upper surface 84 of the pieces of filler 82. The lower surfaces 86 of the pieces of filler 82 are generally coplanar with the lower end turns 72 of the tall springs 58, defining a lower surface 83 of the product in a generally horizontal plane $P_4$. An upholstered covering 89 surrounds the pieces of filler 76,82 and the spring core 12*a*.

The bedding or seating product 10*a* is divided into sections of differing firmness. Moving from right to left as illustrated in FIGS. 2 and 2A, the product 10*a* is divided into a head section 90, an upper back section 92, a middle back section 94, a lower back section 96, and a foot section 98. The head, middle back and foot sections 90,94 and 98 each comprise two pieces of filler 76,82 and a plurality of rows of short coil springs 56 of a height $H_4$. The upper and lower back sections 92,96 each comprise a plurality of rows of tall coil springs 58 of a height $H_5$. The firmness of the upper and lower back sections 92,96 are greater than the firmness of the head, middle back, and foot sections 90,94,98 due at least in part to the springs in those sections being taller than the springs in the head, middle, back and foot sections.

Figure 3:
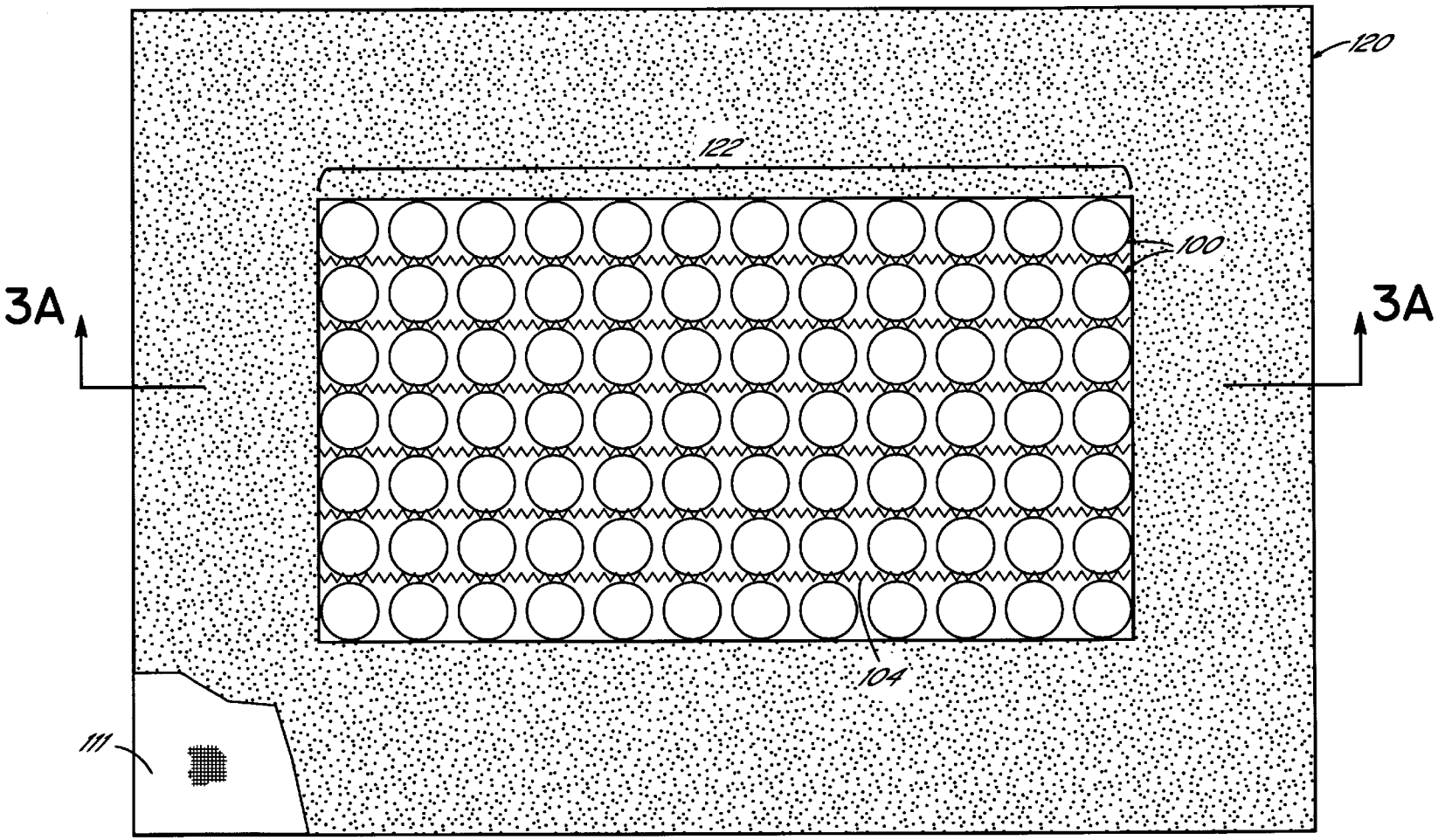
FIG. 3 is a top view of another preferred embodiment of the bedding or seating product made in accordance with the present invention.
Figure 3A:
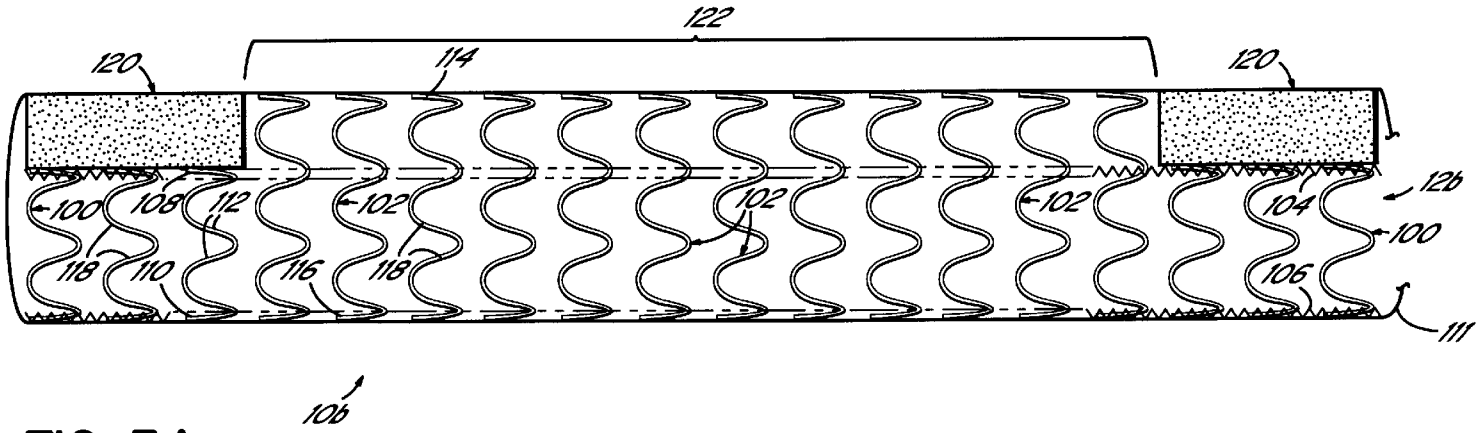
FIG. 3A is a cross-sectional view taken along the line 3A—3A of FIG. 3.

FIGS. 3 and 3A illustrate an alternative preferred embodiment of the present invention. As illustrated in FIG. 3A, a bedding or seating product 10*b* comprises spring core 12*b* made up of a plurality of short coil springs 100 and a plurality of tall coil springs 102 joined together with upper helical lacing wires 104 and lower helical lacing wires 106. Each of the short coil springs 100 has an upper end turn 108, a lower end turn 110 and a plurality of central convolutions 112 between the end turns 108,110. Similarly, each of the tall coil springs 102 has an upper end turn 114, a lower end turn 116 and a plurality of central convolutions 118 between the end turns 114,116. The upper helical lacing wires 104 encircle the upper end turns 108 of the short coil springs 100 and intermediate convolutions 118 of the tall coil springs 102. The lower helical lacing wires 106 encircle the lower end turns 110,116 of all of the coil springs. Filler 120 is located above the upper end turns 108 of the short coil springs 100 around the perimeter of the product. A generally rectangular cental section 122 of tall coil springs 102 creates a central core of increased firmness relative to the firmness of the perimeter of the product. Although not illustrated, the embodiment illustrated in FIGS. 3 and 3A may have filler located underneath the short coil springs, the tall coil springs extending below the lower end turns of the short coil springs as illustrated in FIGS. 2 and 2A. A fabric cover 111 encases the pieces of filler 120 and spring core 12*b*.

Figure 4A:
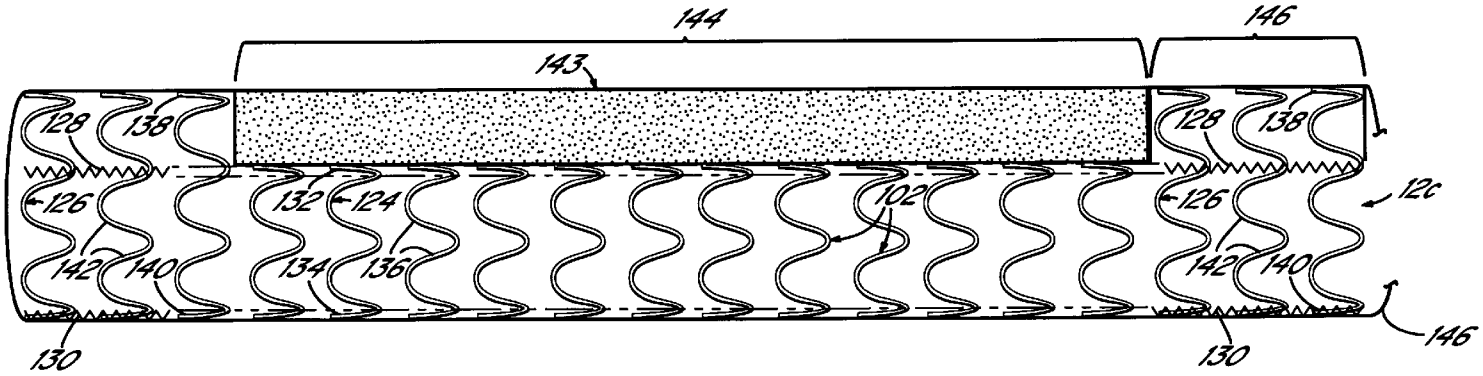
FIG. 4A is a cross-sectional view taken along the line 4A—4A of FIG.4.
Figure 4:
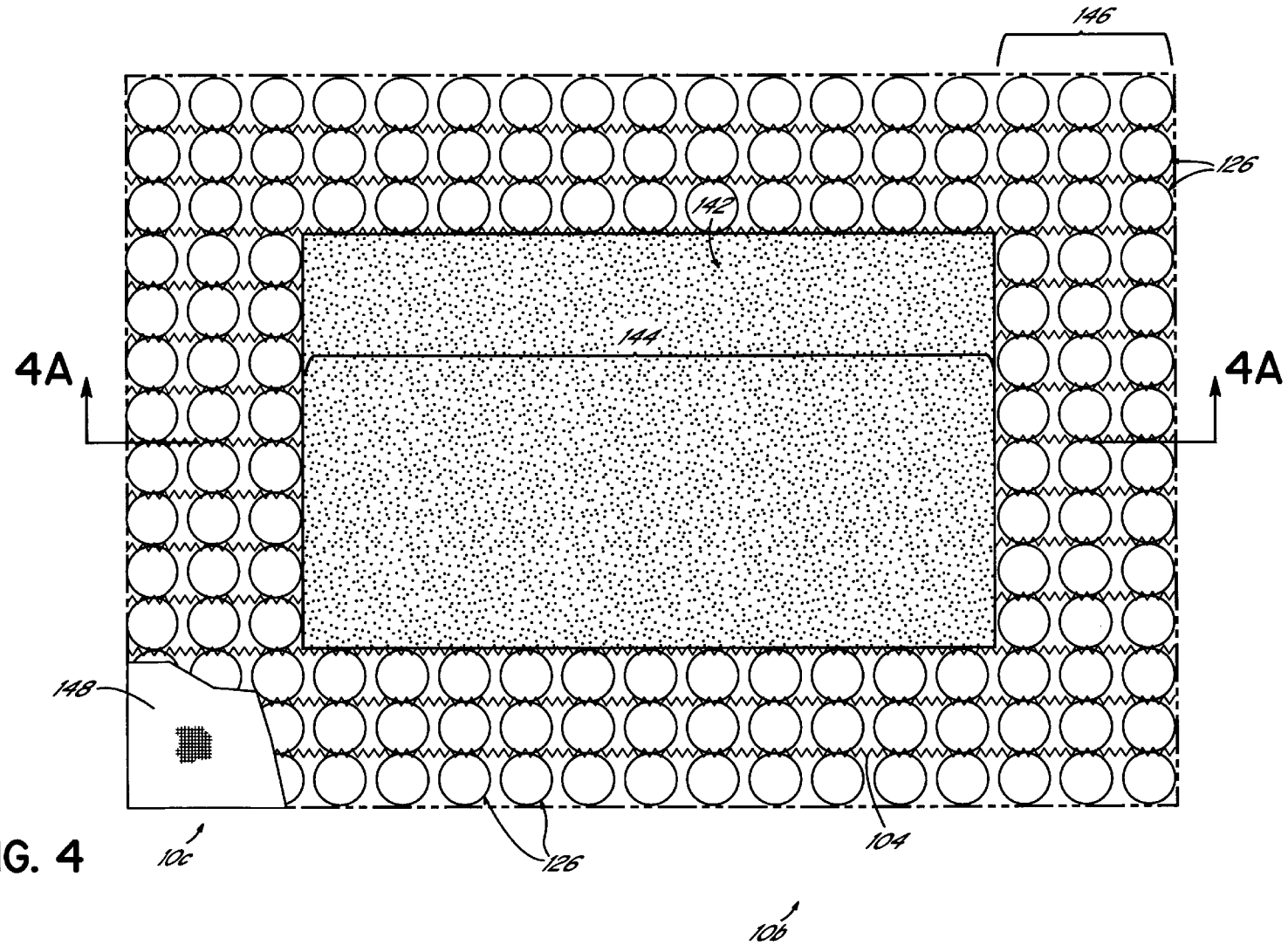
FIG. 4 is a top view of another preferred embodiment of the present invention.

FIGS. 4 and 4A illustrate an alternative preferred embodiment of the present invention 10*c*. As illustrated in FIG. 4A, the product 10*c* comprises a spring core 12*c* made up of a plurality of short coil springs 124 and a plurality of tall coil springs 126 joined together with upper helical lacing wires 128 and lower helical lacing wires 130. Each of the short coil springs 124 has an upper end turn 132, a lower end turn 134 and a plurality of central convolutions 136 between the end turns 132,134. Similarly, each of the tall coil springs 126 has an upper end turn 138, a lower end turn 140 and a plurality of central convolutions 142 between the end turns 138,140.

The upper helical lacing wires 128 encircle the upper end turns 132 of the short coil springs 124 and intermediate convolutions 142 of the tall coil springs 126. The lower helical lacing wires 130 encircle the lower end turns 134,140 of all of the coil springs. Filler 143 is located above the upper end turns 132 of the short coil springs 124 in a generally rectangular central section 144 of the product. Tall coil springs 126 are arranged around the perimeter of the central section 144 of the product. The tall coil springs 126 are of an increased firmness relative to the firmness of the central section 144 of the product. Therefore, the tall coil springs 126 provide an edge support section 146 around the perimeter of the product of increased firmness. The edge support section 146 and central section 144 of the product may be any thickness or size desired. Although not illustrated, the embodiment illustrated in FIGS. 4 and 4A may have filler located underneath the short coil springs, the tall coil springs extending below the lower end turns of the short coil springs as illustrated in FIGS. 2 and 2A. Covering material including an upholstered covering 148 encases the filler 143 and spring core 12*c*.

Figure 5:
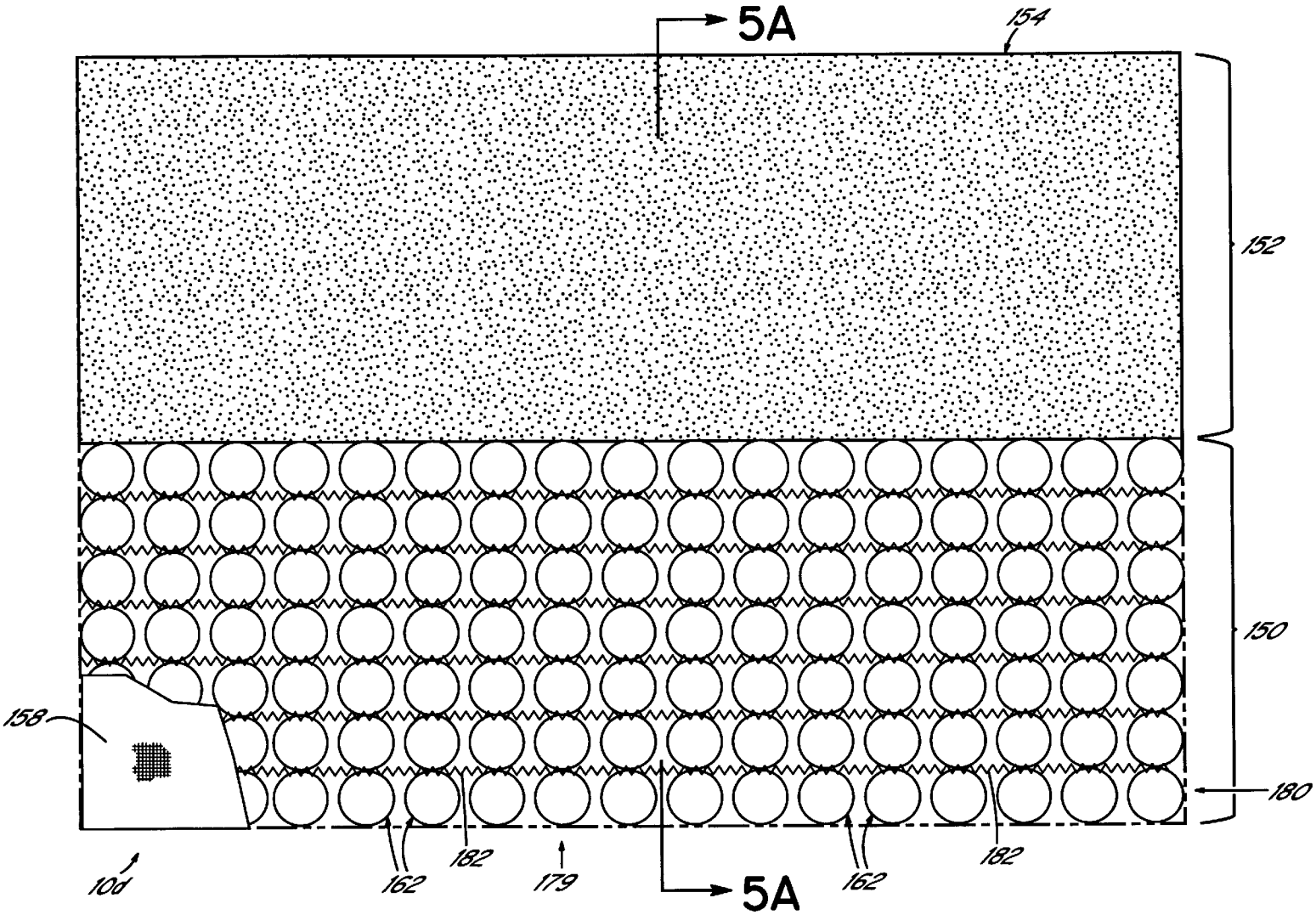
FIG. 5 is a top view of another preferred embodiment of the present invention.
Figure 5A:
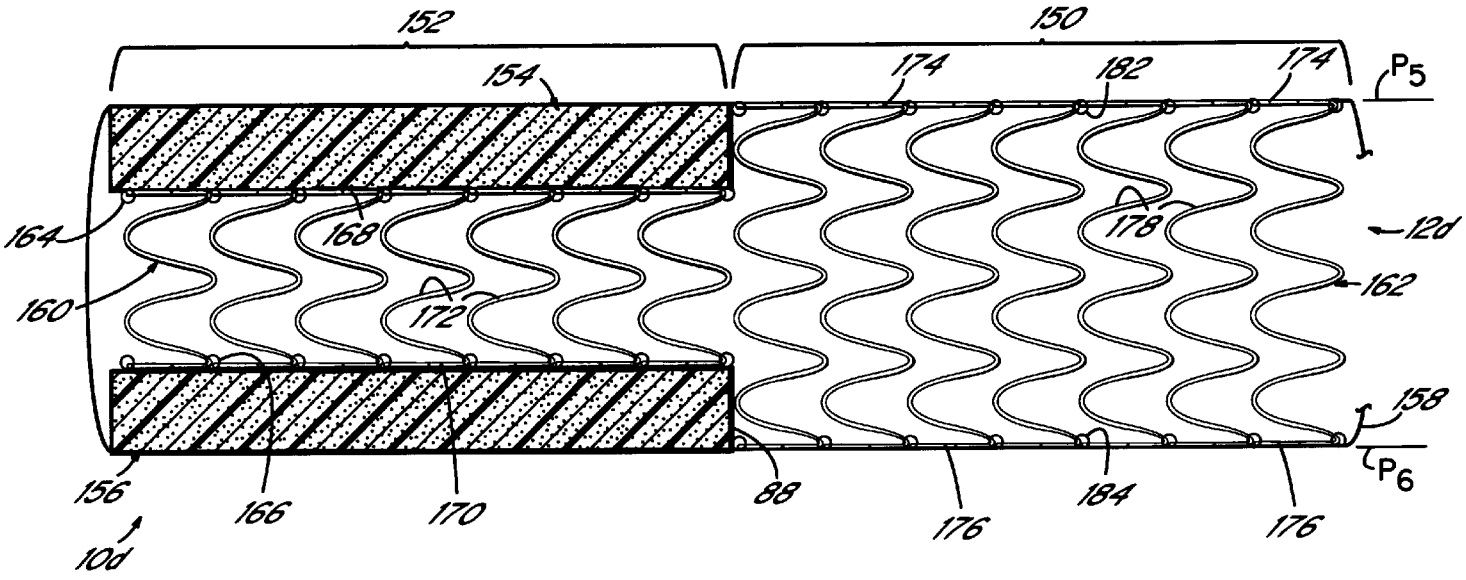
FIG. 5A is a cross-sectional view taken along the line 5A—5A of FIG. 5.

FIGS. 5 and 5A illustrate an alternative preferred embodiment of the present invention in which the sections of the product extend longitudinally. Referring to FIG. 5, there is illustrated a product 10*d* having two sections of differing firmness, a firm section 150 and a soft section 152. Referring to FIG. 5A, the product 10*d* comprises a spring core 12*d* and pieces of filler 154,156 surrounded in an upholstered covering 158. The spring core 12*d* comprises a plurality of short coil springs 160 of an identical height and a plurality of tall coil springs 162 of an identical height arranged in transversely extending rows 179 and longitudinally extending columns (see FIG. 5). As seen in FIG. 5A, adjacent longitudinally extending columns 180 of short coil springs 160 are joined together with upper helical lacing wires 164 and lower helical lacing wires 166. Each of the short coil springs 160 has an upper end turn 168, a lower end turn 170 and a plurality of central convolutions 172. Similarly, each of the tall coil springs 162 has an upper end turn 174, a lower end turn 176 and a plurality of central convolutions 178. Adjacent longitudinally extending columns 180 of tall coil springs 162 are joined together with upper helical lacing wires 182 located generally in horizontal plane $P_5$ and lower helical lacing wires 184 located generally in horizontal plane $P_6$. At least one piece of filler 154 rests on top of the upper end turns 168 of the short coil springs 160. Similarly, at least one piece of filler 156 rests below the lower end turns 170 of the short coil springs 160.

The firm section 150 comprises a plurality of columns 180 of tall coil springs 162 extending from head to foot or longitudinally. Similarly, the soft section 150 comprises a plurality of columns of short coil springs 160, along with pieces of filler 154,156. If a one-sided product is desired, the soft section 152 may comprise columns of short coil springs and only one piece of filler located above the short springs. In this embodiment, although the upper and lower helical lacing wires are illustrated as extending longitudinally, they may extend transversely.

While I have described several preferred embodiments of the present invention, those skilled in the art will appreciate changes and modifications which can be made to the present invention without departing from the scope of the present invention. For example, springs other than individual coil springs, such as for example bands of coil springs may be incorporated into the spring core of any of the embodiments of the present invention. Therefore, I intend to be limited only be the scope of the following claims.

I claim:

1. A bedding or seating product comprising:

a spring core comprising a plurality of coil springs arranged in transversely extending rows and longitudinally extending columns, each of said coil springs having an upper end turn, a lower end turn and a plurality of central convolutions between said end turns, said spring core being divided into sections, each of said sections comprising a plurality of said of coil springs, said coil springs of at least one of said sections being of a first height and said coil springs of at least one of said sections being of a second height, said second height being greater than said first height, filler located above only said coil springs of said first height; and an upholstered covering surrounding said filler and said spring core.

2. The bedding or seating product of claim 1 wherein said coil springs are joined together with upper helical lacing wires, said upper helical lacing wires encircling the upper end turns of said coil springs of said first height and intermediate convolutions of said coil springs of said second height.

3. The bedding or seating product of claim 1 wherein said filler comprises urethane foam.

4. The bedding or seating product of claim 2 wherein lower helical lacing wires encircle the lower end turns of all of said coil springs.

5. The bedding or seating product of claim 2 wherein lower helical lacing wires encircle the lower end turns of said coil springs of said first height and intermediate convolutions of said coil springs of said second height.

6. The bedding or seating product of claim 5 further comprising filler below said coils springs of said first height.

7. The bedding or seating product of claim 1 wherein said filler is of a third height such that a sum of said first and third heights equals said second height.

8. The bedding or seating product of claim 1 wherein each of said sections comprises a plurality of transversely extending rows of coil springs.

9. The bedding or seating product of claim 1 wherein each of said sections comprises a plurality of longitudinally extending columns of coil springs.

10. A bedding or seating product comprising:

a spring core comprising a plurality of coil springs arranged in transversely extending rows and longitudinally extending columns, each of said coil springs having an upper end turn, a lower end turn and a plurality of central convolutions between said end turns, said product being divided into soft sections and firm sections, each of said soft sections comprising a plurality of said transversely extending rows of short coil springs and filler located above said short coil springs, each of said firm sections comprising a plurality of said transversely extending rows of tall coil springs, said upper end turns of said tall coil springs being substantially coplanar with upper surfaces of said filler; and an upholstered covering surrounding said filler and said spring core.

11. The bedding or seating product of claim 10 wherein said coil springs are joined together with longitudinally extending upper and lower helical lacing wires.

12. The bedding or seating product of claim 11 wherein said upper helical lacing wires encircle the upper end turns of the short coil springs and one of the intermediate convolutions of the tall coil springs.

13. The bedding or seating product of claim 11 wherein said lower helical lacing wires encircle the lower end turns of the coil springs.

14. The bedding or seating product of claim 11 wherein said tall coil springs extend below the lower end turns of said short coil springs and said lower helical lacing wires encircle the lower end turns of the short coil springs and one of the intermediate convolutions of the tall coil springs.

15. The bedding or seating product of claim 10 further comprising filler located below said short coil springs of said soft sections of said product.

16. A bedding or seating product comprising:

a spring core comprising a plurality of coil springs arranged in transversely extending rows and longitudinally extending columns, each of said coil springs having an upper end turn, a lower end turn and a plurality of central convolutions between said end turns, said product being divided into soft sections and firm sections, each of said soft sections comprising a plurality of said transversely extending rows of short coil springs and filler located above said short coil springs, each of said firm sections comprising a plurality of said transversely extending rows of tall coil springs, said tall coil springs extending above said upper end turns of said short coil springs and below said lower end turns of said short coil springs, filler located above and below said short coil springs such that said upper and lower end turns of said tall coil springs are substantially coplanar with upper and lower surfaces of said filler; and an upholstered covering surrounding said filler and said spring core.

17. The bedding or seating product of claim 16 wherein filler comprises urethane foam.

18. A bedding or seating product comprising:

a spring core comprising a plurality of coil springs arranged in transversely extending rows and longitudinally extending columns, each of said coil springs having an upper end turn, a lower end turn and a plurality of central convolutions between said end turns, said spring core having a central section of short coil springs and tall coil springs surrounding said central section of short coil springs, filler located above said short coil springs, said filler have an upper surface substantially coplanar with said upper end turns of said tall coil springs; and an upholstered covering surrounding said spring core and filler.

19. A bedding or seating product comprising:

a spring core comprising a plurality of coil springs arranged in transversely extending rows and longitudinally extending columns, each of said coil springs having an upper end turn, a lower end turn and a plurality of central convolutions between said end turns, said spring core having a central section of tall coil springs and a section of short coil springs surrounding said central section of tall coil springs, filler located above said short coil springs, and an upholstered covering surrounding said spring core and filler.

* * * * *

UNITED STATES PATENT AND TRADEMARK OFFICE

CERTIFICATE OF CORRECTION

PATENT NO. : 6,353,952 B1
DATED : March 12, 2002
INVENTOR(S) : Thomas J. Wells

It is certified that error appears in the above-identified patent and that said Letters Patent is hereby corrected as shown below:

Column 3,
Line 25, "to the user around the perimeter than in center of this embodiment of product" should read -- to the user around the perimeter than in the center of this embodiment of the product --.
Line 29, "a section of short coil springs are arranged in" should read -- a section of short coil springs is arranged in --.

Column 5,
Line 13, "facing" should read -- lacing --.
Line 61, "Pieces of filler 76 are located both above the upper end turns 64 of the short coil spring 56" should read -- Pieces of filler 76 are located above the upper end turns 64 of the short coil springs 56 --.

Column 6,
Line 27, "The firmness of the upper and lower back sections 92, 96 are greater than" should read -- The firmness of the upper and lower back sections 92, 96 is greater than --.

Column 8,
Line 9, "a plurality of said of" should read -- a plurality of said --.
Line 34, "said coils springs" should read -- said coil springs --.

Signed and Sealed this

Fifteenth Day of October, 2002

*Attest:*

*Attesting Officer*

JAMES E. ROGAN
*Director of the United States Patent and Trademark Office*